US012022916B2

(12) United States Patent
Pratt et al.

(10) Patent No.: US 12,022,916 B2
(45) Date of Patent: Jul. 2, 2024

(54) RAPID-ENTRY FOOTWEAR HAVING AN ACTUATOR ARM

(71) Applicant: FAST IP, LLC, Vineyard, UT (US)

(72) Inventors: Michael Pratt, Alpine, UT (US); Steven Hermann, Eagle Mountain, UT (US); Seth Lytle, Pleasant Grove, UT (US); Craig Cheney, Lindon, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 17/133,613

(22) Filed: Dec. 23, 2020

(65) Prior Publication Data

US 2021/0112911 A1 Apr. 22, 2021

Related U.S. Application Data

(63) Continuation of application No. PCT/US2019/039944, filed on Jun. 28, 2019.

(60) Provisional application No. 62/755,123, filed on Nov. 2, 2018, provisional application No. 62/691,201, filed on Jun. 28, 2018.

(51) Int. Cl.

| | |
|---|---|
| ***A43B 3/24*** | (2006.01) |
| ***A43B 11/00*** | (2006.01) |
| ***A43B 21/32*** | (2006.01) |
| ***A43B 23/02*** | (2006.01) |
| ***A43C 11/00*** | (2006.01) |
| ***A43C 11/14*** | (2006.01) |
| *A43C 11/20* | (2006.01) |

(52) U.S. Cl.

CPC ..... *A43C 11/14* (2013.01); *A43B 3/242* (2013.01); *A43B 11/00* (2013.01); *A43B 21/32* (2013.01); *A43B 23/027* (2013.01); *A43C 11/004* (2013.01); *A43C 11/008* (2013.01); *A43C 11/20* (2013.01)

(58) Field of Classification Search

CPC ..... A43B 3/101; A43B 3/102; A43B 11/00; A43B 23/08; A43B 23/088; A43B 23/10; A43B 23/105; A43B 3/122; A43B 3/08; A43B 3/04; A43B 23/26

See application file for complete search history.

(56) References Cited

U.S. PATENT DOCUMENTS

| | | | |
|---|---|---|---|
| 112,439 | A | 3/1871 | Francis |
| 287,312 | A | 10/1883 | Packard |

(Continued)

FOREIGN PATENT DOCUMENTS

| | | | |
|---|---|---|---|
| CN | 1403041 | A | 3/2003 |
| CN | 201005111 | Y | 1/2008 |

(Continued)

OTHER PUBLICATIONS https://us.ecco.com/ecco-biom-fjuel-mens-outdoor-shoe-837594.html?dwvar_837594_color=00001 submitted herewith as of Jun. 1, 2016.

(Continued)

*Primary Examiner* — Katharine G Kane

(57) ABSTRACT

A rapid-entry shoe includes an actuator arm, having a pivot point, and a closure system. Movement of the actuator arm from an uncollapsed position to a collapsed position opens the closure system and movement of the actuator arm from the collapsed position to the uncollapsed position closes the closure system, according to various embodiments.

12 Claims, 12 Drawing Sheets

(56) References Cited

U.S. PATENT DOCUMENTS 736,156 A 8/1903 Roberts
808,948 A 1/1906 Roberts
827,330 A 7/1906 Tillson
863,549 A 8/1907 H. Metz
881,153 A 3/1908 Rickert
921,461 A 5/1909 Rickert
923,860 A 6/1909 Kroell
1,081,678 A 12/1913 Meyer
1,116,462 A 11/1914 Moran
1,266,620 A 5/1918 Peabody
1,464,342 A 8/1923 Rothacher
1,494,236 A 5/1924 Greathouse
1,686,175 A 10/1928 Read
1,926,818 A 9/1933 Rateliff
2,069,752 A 2/1937 Dorr
2,083,390 A 6/1937 Murena
2,118,019 A 5/1938 Benjafield
2,266,732 A 12/1941 Babinchak
2,297,594 A 9/1942 Weinstat
2,368,514 A 1/1945 Baehr
2,450,250 A 9/1948 Napton
2,452,502 A 10/1948 Tarbox
2,693,039 A 11/1954 Balut
2,736,110 A 2/1956 Hardimon
2,763,071 A 9/1956 Napier
2,829,448 A 4/1958 Minera
2,920,402 A 1/1960 Minera
3,000,116 A 9/1961 Joseph
3,014,288 A 12/1961 Evans et al.
3,040,454 A 6/1962 Topper et al.
3,097,438 A 7/1963 Evans
3,146,535 A 9/1964 Owings
3,192,651 A 7/1965 Smith
3,373,512 A 3/1968 Jacobson
3,643,350 A 2/1972 Paoletta et al.
3,798,802 A 3/1974 Saunders
4,489,509 A 12/1984 Libit
4,590,690 A 5/1986 Pfander
4,596,080 A 6/1986 Benoit et al.
4,805,321 A 2/1989 Tonkel
4,811,502 A 3/1989 Barret
4,924,605 A * 5/1990 Spademan ..... A43C 11/00 36/114
4,972,613 A * 11/1990 Loveder ..... A43B 5/00 36/105
4,979,319 A 12/1990 Hayes
5,054,216 A 10/1991 Lin
5,090,140 A 2/1992 Sessa
5,127,170 A 7/1992 Messina
5,174,050 A 12/1992 Gabrielli
5,181,331 A 1/1993 Berger
5,184,410 A 2/1993 Hamilton
5,257,470 A 11/1993 Auger et al.
5,259,126 A 11/1993 Rosen
5,265,353 A 11/1993 Marega et al.
5,282,327 A 2/1994 Ogle
5,311,678 A 5/1994 Spademan
5,341,583 A 8/1994 Hallenbeck
5,351,583 A 10/1994 Szymber et al.
5,353,526 A 10/1994 Foley et al.
5,371,957 A 12/1994 Gaudio
5,430,961 A 7/1995 Faulconer et al.
5,467,537 A 11/1995 Aveni et al.
5,481,814 A 1/1996 Spencer
5,806,208 A 9/1998 French
5,842,292 A 12/1998 Siesel
5,846,063 A 12/1998 Lakic
5,983,530 A 11/1999 Chou
6,000,148 A 12/1999 Cretinon
6,014,823 A 1/2000 Lakic
6,125,555 A 10/2000 Schenkel
6,128,837 A 10/2000 Huang
6,170,173 B1 1/2001 Caston
6,189,239 B1 2/2001 Gasparovic et al.
6,290,559 B1 9/2001 Scott
6,321,466 B1 11/2001 Bordin et al.
6,360,454 B1 3/2002 Dachgruber et al.
6,367,171 B1 4/2002 Burt
6,378,230 B1 4/2002 Rotem et al.
6,427,361 B1 8/2002 Chou
6,470,537 B1 10/2002 Schallenkamp
6,643,954 B2 11/2003 Voswinkel
6,671,980 B1 1/2004 Liu
6,684,533 B1 2/2004 Su
6,839,985 B2 1/2005 Bettiol
6,877,252 B2 4/2005 Wilkinson
6,922,917 B2 8/2005 Kerns et al.
6,925,732 B1 8/2005 Clarke
6,938,361 B2 9/2005 Su
7,059,068 B2 6/2006 Magallanes et al.
7,103,994 B2 9/2006 Johnson
7,178,270 B2 2/2007 Hurd et al.
7,225,563 B2 6/2007 Chen et al.
7,439,837 B2 10/2008 McDonald
D583,956 S 12/2008 Chang et al.
7,661,205 B2 2/2010 Johnson
7,685,747 B1 3/2010 Gasparovic et al.
7,757,414 B2 7/2010 Tonkel
7,793,438 B1 9/2010 Busse et al.
D648,512 S 11/2011 Schlageter et al.
8,065,819 B2 * 11/2011 Kaufman ..... A43C 11/008 36/122
8,161,669 B2 4/2012 Keating
8,225,535 B2 7/2012 Dillenbeck
8,302,329 B2 11/2012 Hurd et al.
8,333,021 B2 12/2012 Johnson
8,499,474 B2 * 8/2013 Kaufman ..... A43C 11/00 36/138
8,745,901 B2 6/2014 Toraya
8,769,845 B2 7/2014 Lin
9,119,441 B2 9/2015 Frappier
9,314,067 B2 4/2016 Bock
9,351,532 B2 5/2016 Mokos
9,615,624 B2 4/2017 Kilgore et al.
9,629,416 B2 4/2017 Rackiewicz et al.
9,635,905 B2 5/2017 Dekovic
9,675,132 B2 6/2017 Marshall
9,717,304 B2 8/2017 Bernhard et al.
9,820,527 B2 11/2017 Pratt et al.
9,999,278 B2 6/2018 Feinstein
10,327,515 B2 6/2019 Peyton et al.
D854,303 S 7/2019 Flanagan et al.
10,455,898 B1 10/2019 Orand et al.
10,499,707 B2 12/2019 Hobson et al.
10,506,842 B2 12/2019 Pratt et al.
10,537,154 B2 1/2020 Smith et al.
10,568,382 B2 2/2020 Hatfield et al.
10,609,981 B1 4/2020 Phinney
10,617,174 B1 4/2020 Hopkins et al.
10,638,810 B1 5/2020 Cheney et al.
10,653,209 B2 5/2020 Pratt et al.
10,660,401 B1 5/2020 Pratt et al.
10,765,167 B2 9/2020 Azoulay et al.
10,791,796 B1 10/2020 Baker
10,813,405 B2 10/2020 Pratt
10,912,348 B2 2/2021 Owings et al.
10,973,278 B2 4/2021 Raia
11,000,091 B1 5/2021 Kyle
11,140,941 B2 10/2021 Xanthos et al.
11,154,113 B2 10/2021 Hatfield et al.
11,172,727 B2 11/2021 Hatfield et al.
11,191,320 B2 12/2021 Happen
11,213,098 B2 1/2022 Beers et al.
11,234,482 B2 2/2022 Roser
D948,190 S 4/2022 Jury
D948,191 S 4/2022 Holmes
D949,540 S 4/2022 Jury
D949,544 S 4/2022 Witherow
D955,732 S 6/2022 Kelley
11,633,016 B2 4/2023 Orand et al.
11,659,886 B2 5/2023 Cheney et al.
11,700,916 B2 7/2023 Kilgore et al.
11,707,113 B2 7/2023 Hopkins et al.
D993,601 S 8/2023 Wang et al.

(56) References Cited

U.S. PATENT DOCUMENTS 11,737,511 B2 8/2023 Cheney et al.
11,744,319 B2 9/2023 Farina
2001/0001350 A1 5/2001 Aguerre
2002/0053147 A1 5/2002 Borsoi et al.
2002/0066213 A1 6/2002 Wells
2002/0095823 A1 7/2002 Laio et al.
2002/0144434 A1 10/2002 Farys et al.
2002/0174568 A1 11/2002 Neiley
2003/0106244 A1 6/2003 Miller et al.
2004/0003517 A1 1/2004 Marvin et al.
2004/0088890 A1 5/2004 Matis et al.
2004/0111921 A1 6/2004 Lenormand
2005/0022428 A1 2/2005 Anderson
2005/0034328 A1 2/2005 Geer
2005/0039348 A1 2/2005 Raluy et al.
2005/0066543 A1 3/2005 Rosen et al.
2005/0198867 A1 9/2005 Labbe
2005/0241189 A1 11/2005 Elkington et al.
2007/0074425 A1 4/2007 Leong
2007/0180730 A1 8/2007 Greene et al.
2007/0209234 A1 9/2007 Chou
2007/0256329 A1 11/2007 Antonelli et al.
2007/0271822 A1 11/2007 Meschter
2007/0277394 A1 12/2007 Hansen et al.
2008/0086911 A1 4/2008 Labbe
2008/0189984 A1 8/2008 Januszewski et al.
2008/0276492 A1 11/2008 Burnett
2008/0307673 A1 12/2008 Johnson
2008/0313929 A1 12/2008 Hoyt
2009/0090026 A1 4/2009 Mosher
2010/0037483 A1 2/2010 Meschter et al.
2010/0095494 A1 4/2010 Martin
2010/0095554 A1 4/2010 Gillespie
2010/0251572 A1 10/2010 Baudouin et al.
2011/0185592 A1 8/2011 Nishiwaki et al.
2011/0214313 A1 9/2011 James et al.
2011/0239489 A1 10/2011 Iuchi et al.
2011/0277350 A1 11/2011 Huynh
2012/0055044 A1 3/2012 Dojan et al.
2012/0060395 A1 3/2012 Blevens et al.
2012/0151799 A1 6/2012 Weinreb
2012/0167413 A1 7/2012 Marvin et al.
2012/0216429 A1 8/2012 Bastida et al.
2012/0317839 A1* 12/2012 Pratt ..... A43C 11/008
36/102
2013/0160328 A1 6/2013 Hatfield et al.
2013/0185959 A1 7/2013 Coleman
2013/0219747 A1 8/2013 Lederer
2013/0312285 A1 11/2013 Sharma et al.
2014/0013624 A1 1/2014 Stockbridge et al.
2014/0090274 A1 4/2014 Arquilla
2014/0101975 A1 4/2014 Ueda
2014/0123516 A1 5/2014 Cressman et al.
2014/0173932 A1 6/2014 Bell
2014/0189964 A1 7/2014 Wen et al.
2014/0202044 A1 7/2014 Adami et al.
2014/0259781 A1 9/2014 Sakai
2014/0298687 A1 10/2014 Flinterman et al.
2014/0305005 A1 10/2014 Yeh
2014/0373396 A1 12/2014 Chang
2015/0013184 A1 1/2015 Beers
2015/0013189 A1 1/2015 Hanak et al.
2015/0020416 A1 1/2015 Wiens
2015/0047222 A1 2/2015 Rushbrook
2015/0047223 A1 2/2015 Flinterman et al.
2015/0165338 A1 6/2015 Choe
2015/0216252 A1 8/2015 Wiens
2015/0305432 A1 10/2015 Wiens
2015/0305442 A1 10/2015 Ravindran
2016/0007674 A1 1/2016 Labonte et al.
2016/0128424 A1 5/2016 Connell et al.
2016/0128429 A1 5/2016 Hatfield et al.
2016/0262492 A1 9/2016 Fujita et al.
2016/0302530 A1 10/2016 Smith et al.
2016/0374427 A1 12/2016 Zahabian
2017/0013915 A1 1/2017 Caston, Jr.
2017/0035148 A1 2/2017 Marvin et al.
2017/0127755 A1 5/2017 Bunnell et al.
2017/0215525 A1 8/2017 Labbe
2017/0265562 A1 9/2017 Mullen
2018/0110292 A1 4/2018 Beers et al.
2018/0199659 A1 7/2018 Lintaman
2018/0235314 A1 8/2018 Farage
2018/0255865 A1 9/2018 Hsu
2018/0263332 A1 9/2018 Bruno
2018/0289109 A1 10/2018 Beers et al.
2018/0295942 A1 10/2018 Drake
2018/0338572 A1 11/2018 Cross et al.
2018/0343968 A1 12/2018 James et al.
2019/0053571 A1 2/2019 Bjornson et al.
2019/0116916 A1 4/2019 Burch
2019/0281920 A1 9/2019 Ito et al.
2019/0289960 A1 9/2019 Loveder
2019/0297999 A1 10/2019 Nakaya et al.
2019/0307208 A1 10/2019 Corcoran-Tadd et al.
2019/0365029 A1 12/2019 Cross et al.
2019/0366667 A1 12/2019 Cross et al.
2020/0015544 A1 1/2020 Pratt
2020/0037703 A1 2/2020 Twist
2020/0046066 A1 2/2020 Difrancisco
2020/0068991 A1 3/2020 Steere et al.
2020/0085136 A1 3/2020 Pratt et al.
2020/0113274 A1 4/2020 Butler
2020/0187590 A1 6/2020 Hopkins et al.
2020/0196703 A1 6/2020 Hopkins
2020/0196787 A1 6/2020 Dament et al.
2020/0205511 A1 7/2020 Hopkins et al.
2020/0205512 A1 7/2020 Blanche et al.
2020/0205516 A1 7/2020 Kilgore
2020/0205518 A1 7/2020 Hopkins et al.
2020/0205520 A1 7/2020 Kilgore
2020/0245797 A1 8/2020 Kim
2020/0253333 A1 8/2020 Kilgore et al.
2020/0305552 A1 10/2020 Cheney et al.
2020/0323308 A1 10/2020 Dubuisson
2020/0375319 A1 12/2020 Yang
2020/0383424 A1 12/2020 Hughes
2021/0030107 A1 2/2021 Pratt et al.
2021/0059351 A1 3/2021 Piacentini
2021/0068493 A1 3/2021 Pratt et al.
2021/0068494 A1 3/2021 Zahabian
2021/0068498 A1 3/2021 Cheney et al.
2021/0106094 A1 4/2021 Cheney
2021/0127788 A1 5/2021 Li
2021/0145114 A1 5/2021 Kyle
2021/0169177 A1 6/2021 Yang
2021/0186146 A1 6/2021 Erwin
2021/0204642 A1 7/2021 Kyle
2021/0204643 A1 7/2021 Kyle
2021/0204644 A1 7/2021 Kyle
2021/0204645 A1 7/2021 Pratt
2021/0227923 A1 7/2021 Love et al.
2021/0282495 A1 9/2021 Davis et al.
2021/0321718 A1 10/2021 Chang
2021/0330033 A1 10/2021 Pratt et al.
2021/0337922 A1 11/2021 Cheney
2021/0345727 A1 11/2021 Raia
2022/0142291 A1 5/2022 Cheney et al.
2022/0240625 A1 8/2022 Shin
2022/0287406 A1 9/2022 Cheney et al.
2022/0287407 A1 9/2022 Cheney et al.
2022/0354220 A1 11/2022 Cheney
2022/0361627 A1 11/2022 Cheney et al.
2022/0369758 A1 11/2022 Pratt
2022/0378144 A1 12/2022 Pratt et al.
2022/0400810 A1 12/2022 Cheney et al.
2023/0030016 A1 2/2023 Pratt et al.
2023/0033366 A1 2/2023 Farina
2023/0035573 A1 2/2023 Bar
2023/0052916 A1 2/2023 Bar
2023/0055164 A1 2/2023 Cheney et al.
2023/0081272 A1 3/2023 Pratt
2023/0084256 A1 3/2023 Brilliant
2023/0218033 A1 7/2023 Cheney

(56) References Cited

U.S. PATENT DOCUMENTS

| | | | |
|---|---|---|---|
| 2023/0225450 | A1 | 7/2023 | Cheney et al. |
| 2023/0263270 | A1 | 8/2023 | Jones |
| 2023/0276897 | A1 | 9/2023 | Cheney et al. |
| 2023/0284737 | A1 | 9/2023 | Bar |

FOREIGN PATENT DOCUMENTS

| | | | |
|---|---|---|---|
| CN | 101991227 | A | 3/2011 |
| CN | 107467775 | A | 12/2017 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| EP | 1059044 | A1 | 12/2000 |
| EP | 1952715 | A1 | 8/2008 |
| EP | 3266327 | A1 | 1/2018 |
| FR | 3066679 | A1 | 11/2018 |
| GB | 2517399 | A | 2/2015 |
| JP | 01-081910 | U | 6/1989 |
| JP | 11-127907 | A | 5/1999 |
| JP | 2001-149394 | A | 6/2001 |
| JP | 2010-104416 | A | 5/2010 |
| JP | 2014-161721 | A | 9/2014 |
| KR | 10-2005-0095542 | A | 9/2005 |
| KR | 10-2009-0093548 | A | 9/2009 |
| KR | 10-2009-0130804 | A | 12/2009 |
| KR | 10-0936510 | B1 | 1/2010 |
| NL | 2000762 | C1 | 1/2009 |
| WO | 2007/080205 | A1 | 7/2007 |
| WO | 2009/089572 | A1 | 7/2009 |
| WO | 2009/154350 | A1 | 12/2009 |
| WO | 2017/004135 | A2 | 1/2017 |
| WO | 2018/230961 | A1 | 12/2018 |
| WO | 2019/215359 | A1 | 11/2019 |
| WO | 2020/176653 | A1 | 9/2020 |
| WO | 2021/162569 | A1 | 8/2021 |
| WO | 2022/221339 | A1 | 10/2022 |
| WO | 2023/049414 | A1 | 3/2023 |
| WO | 2023/064568 | A1 | 4/2023 |

OTHER PUBLICATIONS https://www.teva.com/kids-sandals/hurricane-drift/ 1102483C.html submitted herewith as of Jun. 13, 2019.

U.S. Provisional Application Filed on Date Jun. 29, 2015 by Zahabian., U.S. Appl. No. 62/186,148.

* cited by examiner

RAPID-ENTRY FOOTWEAR HAVING AN ACTUATOR ARM

CROSS-REFERENCE TO RELATED APPLICATIONS

This application is a continuation of, claims priority to and the benefit of PCT Serial No. PCT/US19/39944 filed Jun. 28, 2019 and entitled RAPID-ENTRY FOOTWEAR HAVING AN ACTUATOR ARM. PCT/US19/39944 Serial No. claims the priority to and the benefit of U.S. Provisional Patent Application No. 62/755,123, filed Nov. 2, 2018 entitled "RAPID-ENTRY FOOTWEAR HAVING AN ACTUATOR ARM," and U.S. Provisional Patent Application No. 62/691,201, filed Jun. 28, 2018 entitled "RAPID-ENTRY FOOTWEAR HAVING AN ACTUATOR ARM." All of the aforementioned applications are incorporated herein by reference in their entireties.

BACKGROUND

1. Field

The present disclosure relates to rapid-entry footwear having an actuator arm.

2. Description of the Related Art

Whether due to inconvenience or inability, donning shoes, including tying or otherwise securing the same, may present difficulties to some individuals. The present disclosure addresses this need.

SUMMARY

Disclosed herein, according to various embodiments, is a rapid-entry shoe comprising an actuator arm, having a pivot point, and a closure system. Movement of the actuator arm from an uncollapsed position to a collapsed position opens the closure system and movement of the actuator arm from the collapsed position to the uncollapsed position closes the closure system, according to various embodiments.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, mechanical and structural changes may be made without departing from the spirit and scope of the disclosure. Thus, the detailed description herein is presented for purposes of illustration only and not of limitation. Like numerals may refer to like components.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, coupled or the like may include permanent (e.g., integral), removable, temporary, partial, full, and/or any other possible attachment option. Any of the components may be coupled to each other via bolts, dowels, glue, stitching, welding, soldering, brazing, sleeves, brackets, clips or other means known in the art or hereinafter developed. Additionally, any reference to without contact (or similar phrases) may also include reduced contact or minimal contact.

As used herein, a shoe is any footwear including but not limited to a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, a high top style boot, or other suitable type of shoe.

Figure 1A:
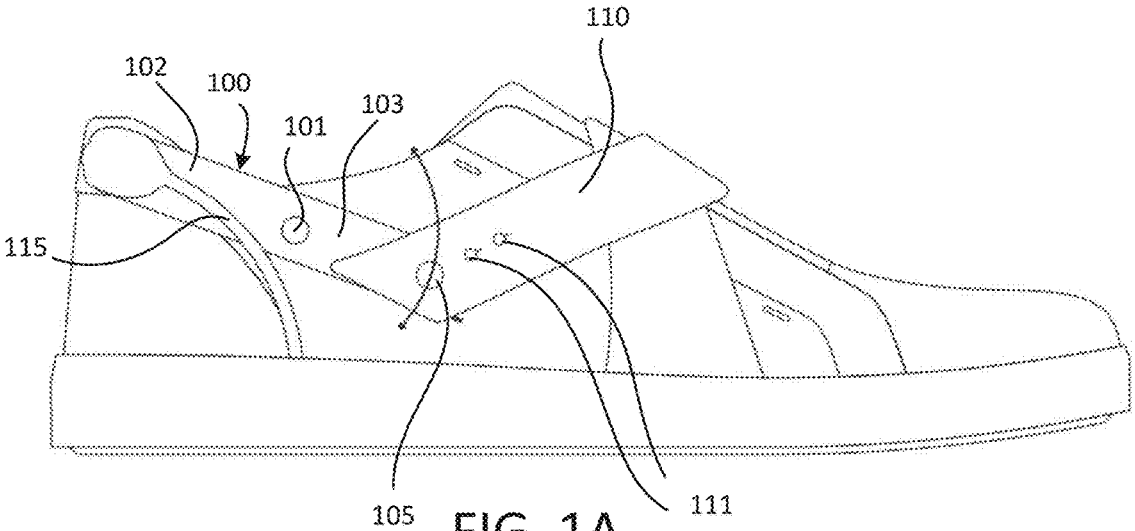
FIGS. 1A and 1B illustrate an example embodiment of a rapid-entry shoe having closure straps extending between actuator arms and the shoe upper or outsole, in uncollapsed and collapsed positions, respectively.
Figure 1B:
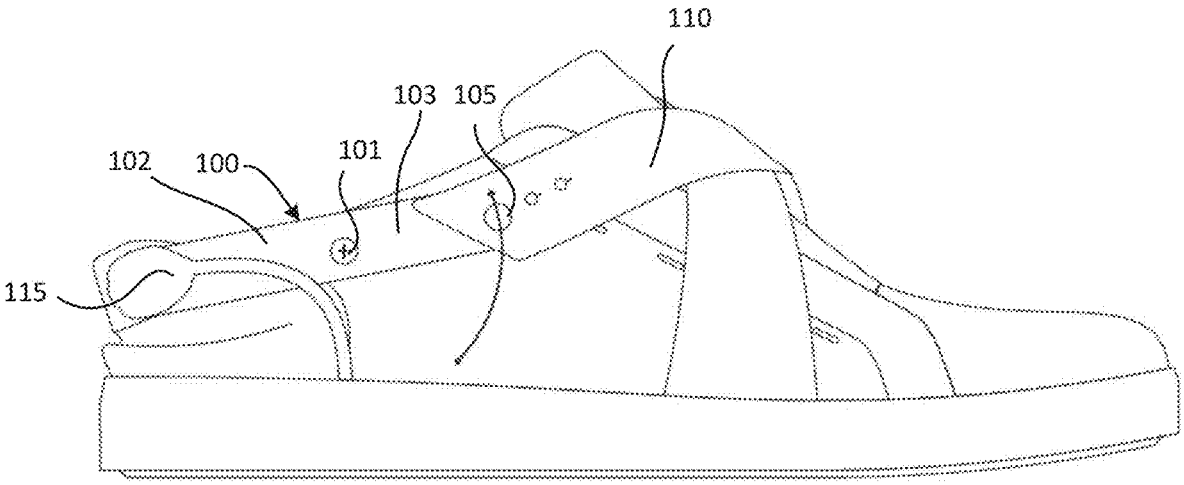

Example embodiments of the present disclosure comprise a shoe having an uncollapsed configuration (FIG. 1A) and a collapsed configuration with a wider opening to receive the foot of an individual wearing the shoe (FIG. 1B). With reference to FIGS. 1A and 1B, example embodiments of the present disclosure comprise an actuator arm 100 extending from a rear portion of the shoe (e.g., connected to the heel or a heel cap, heel counter or the like) and located on a medial and/or lateral side of the shoe. In various embodiments, the rapid-entry shoe also includes a closure system 110 coupled to the actuator arm 100. The actuator arm 100 may include a pivot point 101, and the actuator arm 100 may be generally configured to pivot about the pivot point 101. This pivoting motion of the actuator arm 100 may facilitate switching the shoe between the collapsed position and the uncollapsed position. That is, a user may press downward on the collar of the shoe, causing the actuator arm 100 to collapse, thereby causing the closure system 110 to open (e.g., the foot opening defined by the shoe to increase in size) and facilitating foot insertion. Thus, the actuator arm 100 may be in an uncollapsed position (FIG. 1A) or a collapsed position (FIG. 1B). Accordingly, the terms "collapsed position" or "collapsed configuration" refer to an open state of the shoe in which the rear portion of the shoe is deformed downward (e.g., the rear portion of the actuator arm pivots downward) and the foot opening defined by the shoe is enlarged to allow easier insertion of a foot of the user. Correspondingly, as used herein, the terms "uncollapsed position" or "uncollapsed configuration" refer to a closed state of the shoe in which the rear portion of the shoe is not deformed and is thus upward (relative to the collapsed position) and the foot opening defined by the shoe is sufficiently small to retain a foot within the shoe.

Example embodiments comprise a shoe having two actuator arms, each extending from a rear portion of the shoe (e.g., connected to the heel or a heel cap, heel counter or the like) and located on an opposing medial or lateral side of the shoe. In some embodiments, the actuator arms are coupled to one another around the rear portion of the shoe, while in other embodiments, the actuator arms are independent of each other. While much of the present disclosure will reference a single actuator arm for simplicity, persons skilled in the art will appreciate that two actuator arms, located on an opposing medial or lateral side of the shoe, will be used in various of the embodiments.

In example embodiments, the actuator arm is comprised of a material resistant to deformation, even elastic deformation, e.g., a rigid or hard polymer. In this regard, however, the actuator arm can comprise an overmold or other polymer or textile covering (including the shoe upper or a portion thereof) to minimize discomfort experienced by an individual wearing the shoe. In various embodiments, the actuator arm 100 includes a rear segment 102 and a forward segment 103, with the pivot point 101 disposed therebetween. That is, the portion of the actuator arm 100 behind the pivot point 101 is referred to as the rear segment 102 and the portion of the actuator arm 100 forward of the pivot point 101 is referred to as the forward segment 103, according to various embodiments.

In various embodiments, pivot point 101 is positioned away from the rear portion of the shoe, and is a fixed point around which the actuator arm 100 pivots. For example, in an uncollapsed position, the actuator arm may be oriented downward in the direction away from the rear portion of the shoe, while in a collapsed position, the actuator arm may be oriented level or upward in the direction away from the rear portion of the shoe. The actuator arm may be moved from the uncollapsed position to the collapsed position upon an individual's heel applying a downward force to the rear portion of the shoe upon entry. In various embodiments, movement of the actuator arm 100 from the uncollapsed position to the collapsed position (e.g., transitioning from FIG. 1A to 1B) comprises downward rotational movement of the rear segment 102 and upward rotational movement of the forward segment 103. Correspondingly, movement of the actuator arm 100 from the collapsed position to the uncollapsed position (e.g., transitioning from FIG. 1B to 1A) comprises upward rotational movement of the rear segment 102 and downward rotational movement of the forward segment 103. Thus, the pivot point 101 may be a fulcrum of the actuator arm.

Figure 6A:
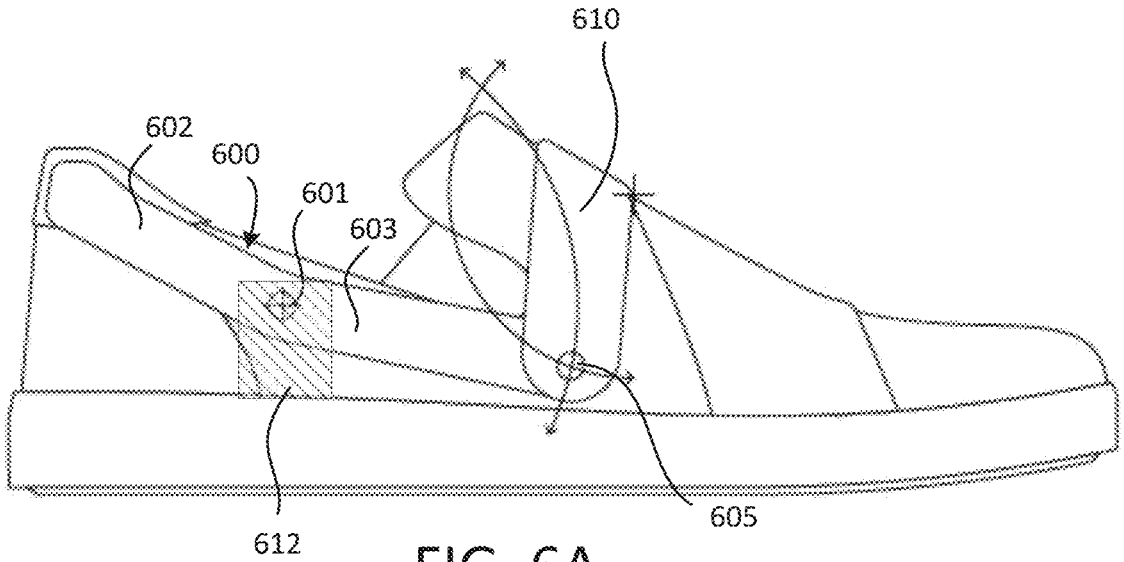
FIGS. 6A and 6B illustrate another example embodiment of a rapid-entry shoe having an angled, bi-stable actuator arm, in uncollapsed and collapsed positions, respectively.
Figure 6B:
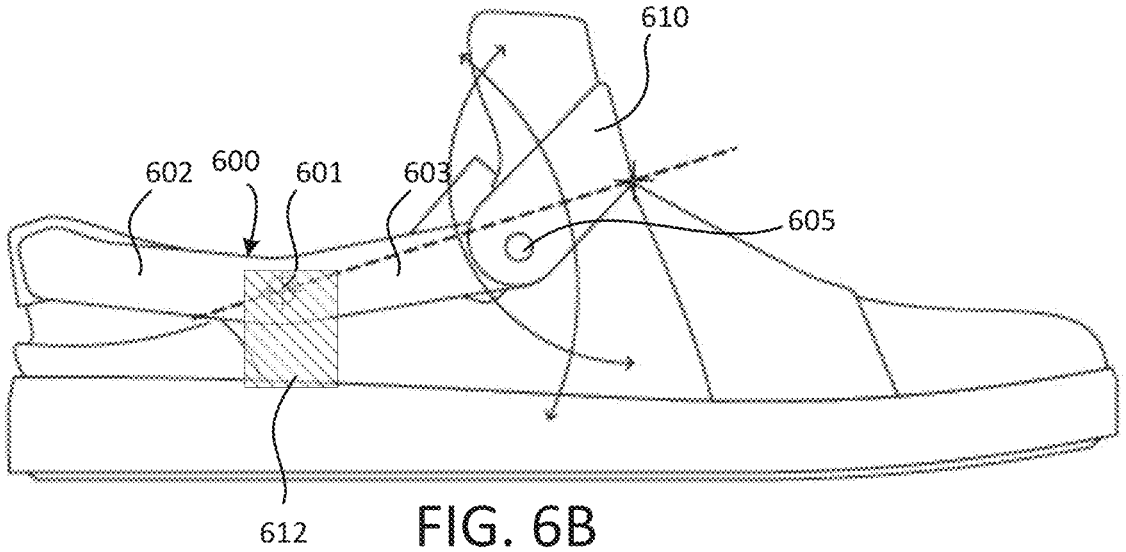
Figure 7A:
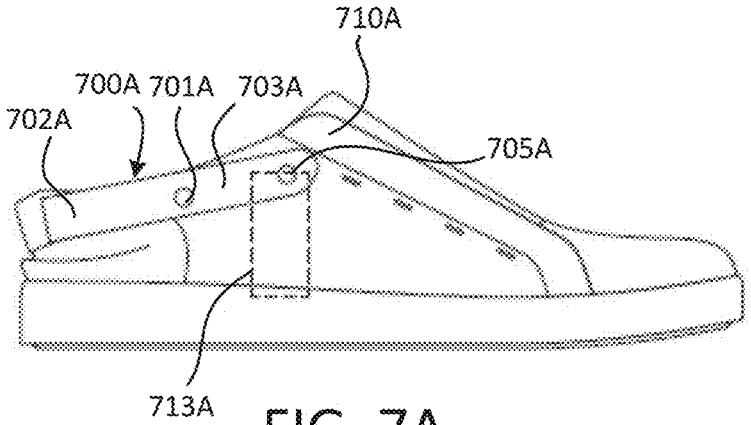
FIG. 7A illustrates an example embodiment of a rapid-entry shoe not comprising a closure strap.
Figure 7B:
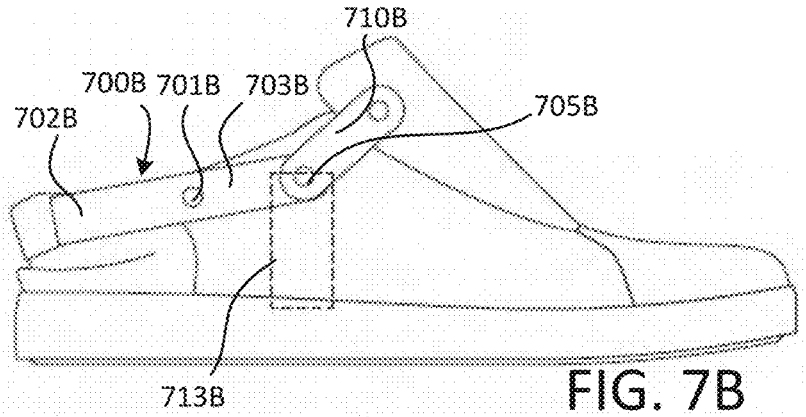
FIGS. 7B, 7C and 7D illustrate example embodiments of rapid-entry shoes similar to those shown in FIGS. 2B, 1B and 3B, respectively, but not comprising deformable elements and showing a biasing member disposed below a coupling point.
Figure 7C:
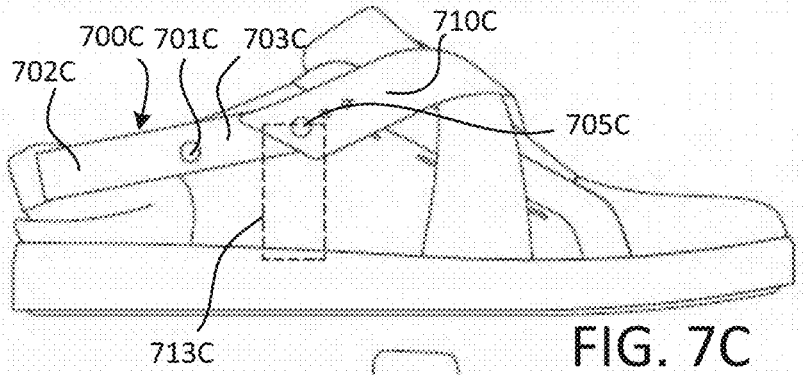
Figure 7D:
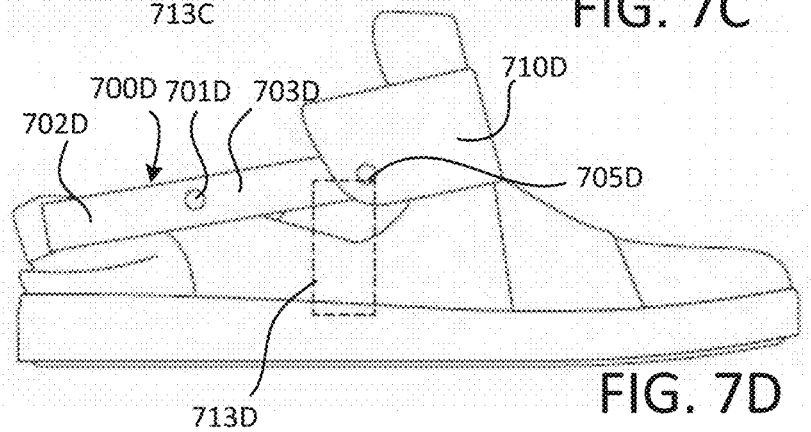

The pivot point may be located between the footbed and topline of the shoe. In various embodiments, the pivot point is below the footbed. The pivot point may comprise a rivet, pin, snap or other structure between the actuator arm and the shoe upper or outsole to provide for rotation there between. In example embodiments, and with momentary reference to FIGS. 6A and 6B, a rigid support 612 may be located below the pivot point 601. The rigid support may be included to prevent collapse of the shoe upper during transition from the uncollapsed position to the collapsed position. For example, the pivot point may be mounted to the rigid support 612. The rigid support 612 may form part of the upper of the shoe, or may be an extension of the outsole or trims. In various embodiments, the pivot point may be fixed and thus may not move relative to the shoe. In various embodiments, the pivot point may be fixed vertically (e.g., may not move upward or downward), but the pivot point may have some play in the forward and rear directions.

In various embodiments, the closure system 110 may be coupled to the forward segment 103 of the actuator arm 100 (e.g., at coupling point 105). Said differently, the actuator arm 100, in accordance with various embodiments, comprises a coupling point 105 positioned further away from the rear portion of the shoe than the pivot point 101, and the coupling point 105 may enable relative rotation between the actuator arm and the closure system. At the coupling point 105, the actuator arm can be coupled to the closure system 110. In various embodiments, the coupling point 105 may be located between the footbed and topline of the shoe. As mentioned below, the coupling point 105 may be nearer to the footbed than the pivot point 101 in the uncollapsed position, but the pivot point 101 may be nearer to the footbed than the coupling point 105 in the collapsed position.

Figure 2A:
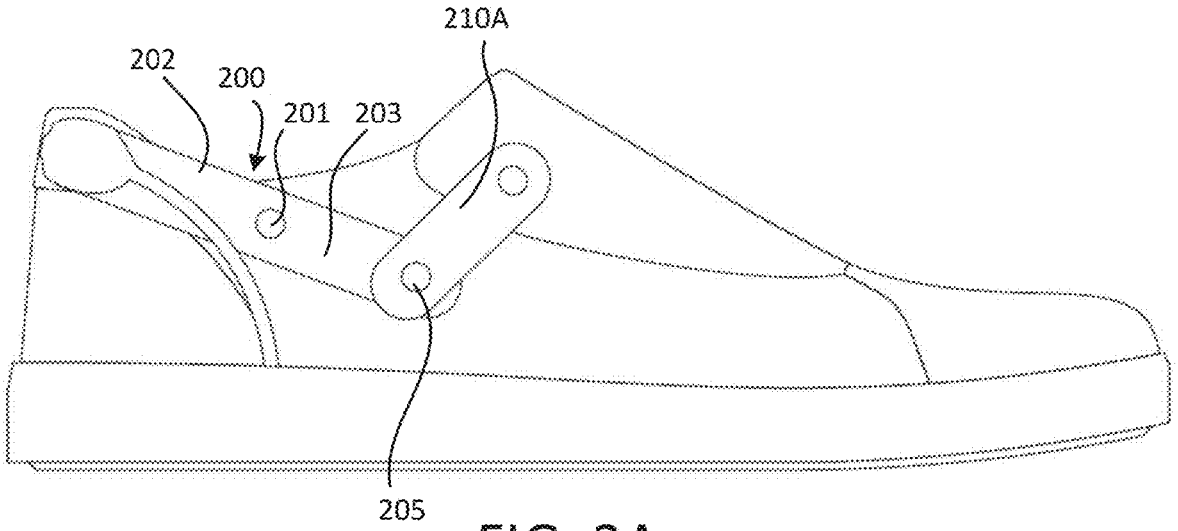
FIGS. 2A and 2B illustrate an example embodiment of a rapid-entry shoe having different closure systems, in uncollapsed and collapsed positions, respectively.
Figure 2B:
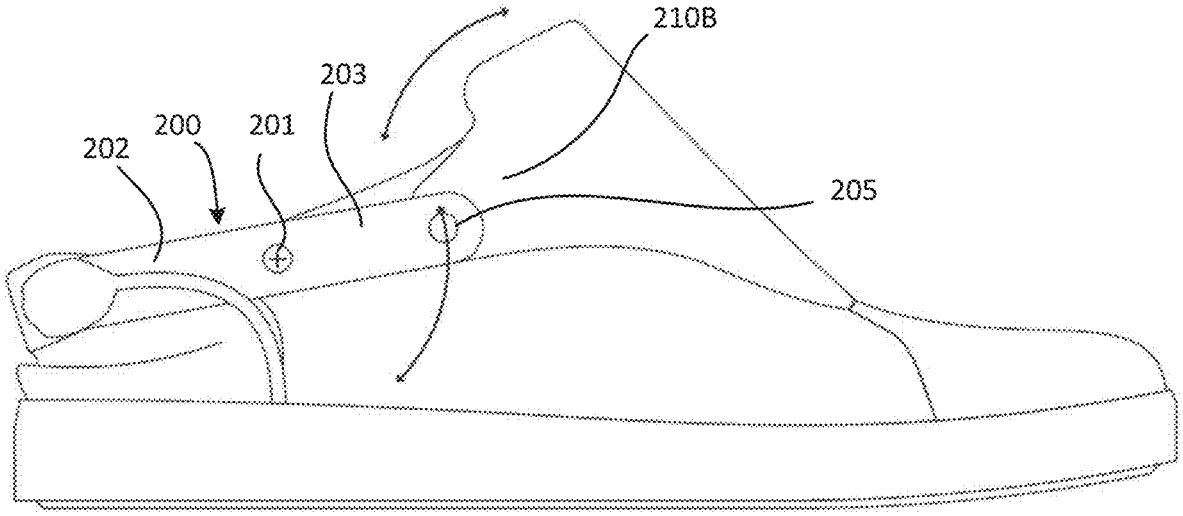

As used herein, the term closure system refers generally to a feature of the shoe that is coupled to the actuator arm at the coupling point. The pivoting movement of the actuator arm is perpetuated by the closure system to enlarge and decrease the foot opening defined by the shoe. In various embodiments, and with reference to FIG. 2A, closure system may be a link 210A (e.g., an additional actuator arm) that extends from the forward segment 203 (e.g., from the coupling point 205) of the actuator arm 100 and is coupled to an upper forward portion of the shoe. In various embodiments, and with reference to FIG. 2B, the closure system is a tongue, closure strap 210B, or other feature of the shoe upper. In such embodiments, downward force on the rear segment 202 of the actuator arm 200 causes the actuator arm 200 to pivot about the pivot point 201, thereby causing the forward segment 203 to move upward, causing a corresponding forward and/or upward movement of the closure system 210A, 210B. In various embodiments, in the uncollapsed position the coupling point 205 is closer to a footbed of the rapid-entry shoe than the pivot point 201, and in the collapsed position the coupling point 205 is farther above the footbed than the pivot point 201. In various embodiments, and with momentary reference to FIGS. 8A and 8B, the actuator arm and closure system could be made of a single part, such that the coupling point could be a living hinge. Additional details pertaining to the living hinge are included below with reference to FIGS. 8A and 8B.

In accordance with example embodiments of the present disclosure, and with momentary reference to FIGS. 5A, 5B, 6A, and 6B, actuator arm 500, 600 may have one or more bends or angles along its axis. That is, instead of the actuator arm being linear when viewed from a lateral or medial side of the rapid entry shoe (see, e.g., FIGS. 1A, 1B, 2A, 2B, 3A, and 3B), the actuator arm may be non-linear (once again, when viewed from a lateral or medial side of the rapid-entry shoe). For example, an angle may be defined between the rear segment 502, 602 and the forward segment 503, 603 of the actuator arm 500, 600, and this angle may be less than 180 degrees. The one or more bends or angles can, in turn, follow the topline of the shoe and/or provide for stability in both the uncollapsed position as well as the collapsed position, depending on where the actuator arm is positioned relative to the rotation center point.

Figure 4A:
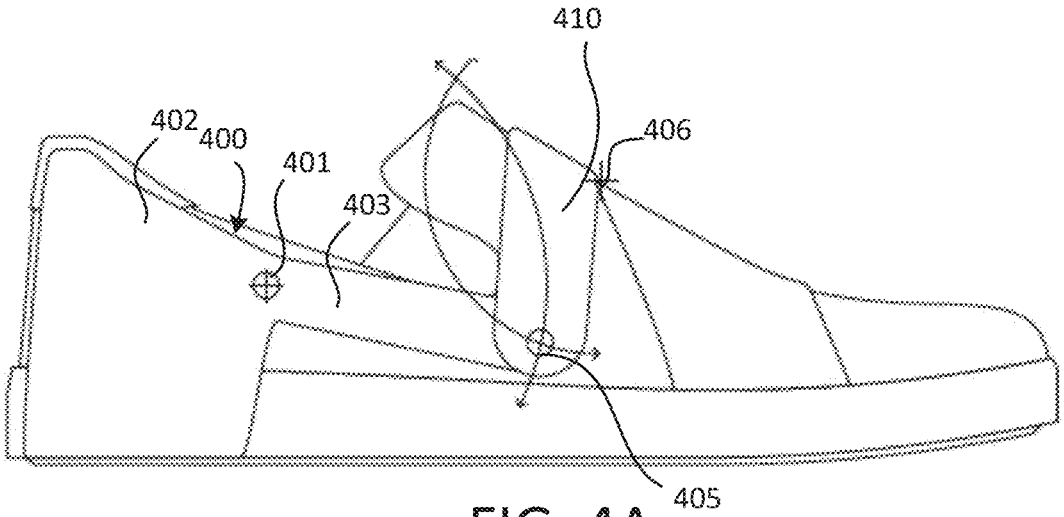
FIGS. 4A and 4B illustrate an example embodiment of a rapid-entry shoe wherein the actuator arm is the heel or a heel cap, heel counter or the like, in uncollapsed and collapsed positions, respectively.
Figure 4B:
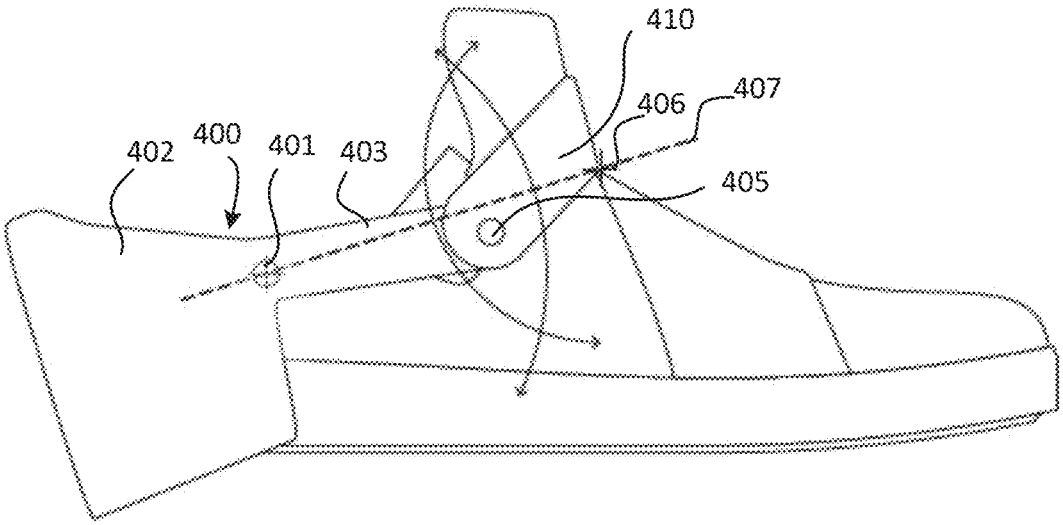
Figure 5A:
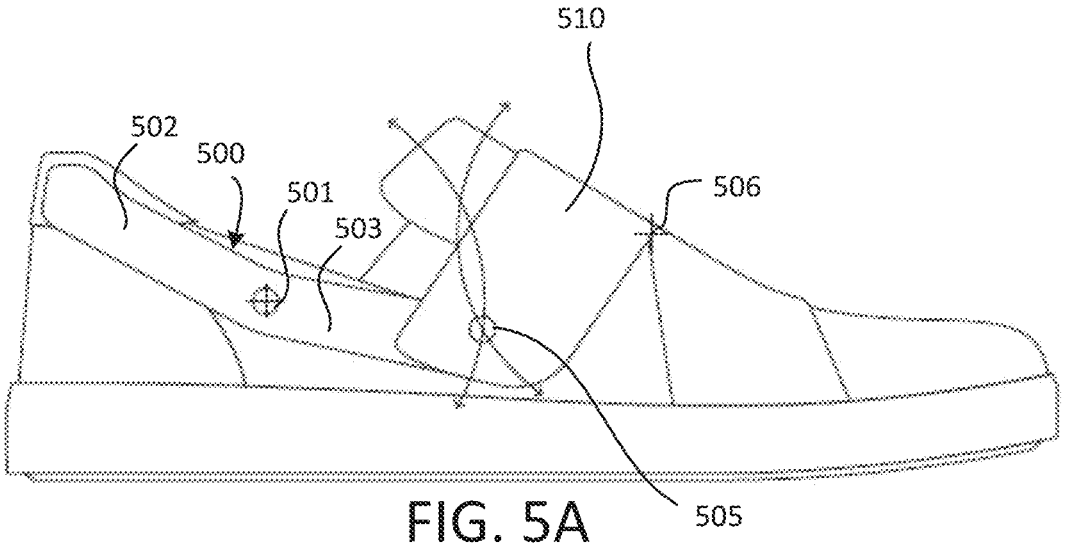
FIGS. 5A and 5B illustrate an example embodiment of a rapid-entry shoe having an angled, bi-stable actuator arm, in uncollapsed and collapsed positions, respectively.
Figure 5B:
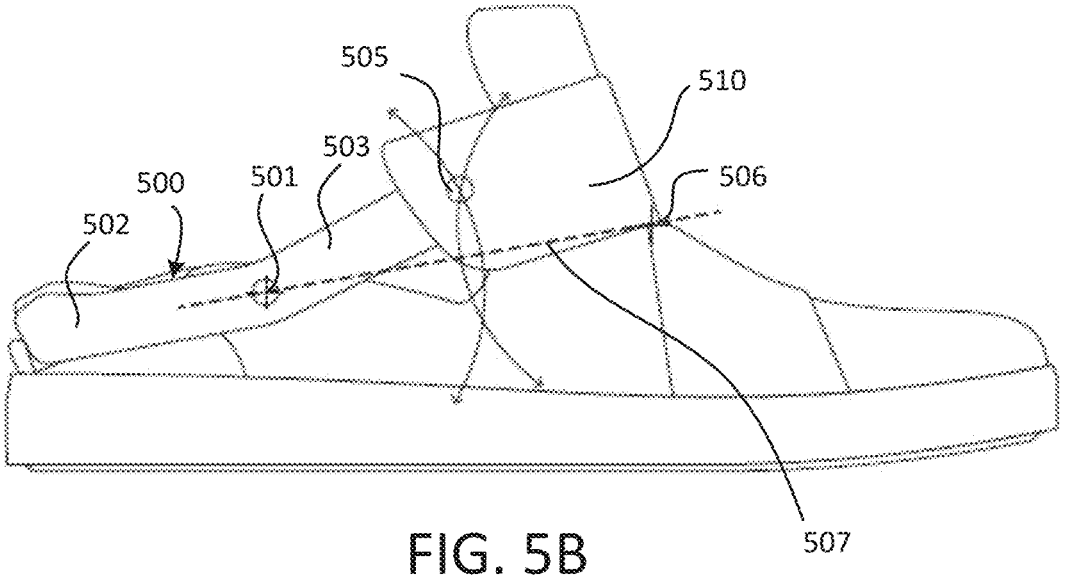

In various embodiments, and with reference to FIGS. 4A and 4B, instead of the actuator arm being connected to the heel, heel cap, heel counter, or the like, the actuator arm 400 is the heel, heel cap, heel counter, or the like. Thus, in the collapsed configuration, the heel or a heel cap, heel counter or the like may be located below the footbed as illustrated in FIG. 4B. The actuator arm in such embodiments may be moved from the uncollapsed position to the collapsed position upon an individual's heel applying a downward force to the footbed of the shoe upon entry.

In various embodiments, and with continued reference to FIGS. 4A and 4B, a bend axis 406 may be defined as an axis, perpendicular to a longitudinal axis of the shoe from a heel portion to a toe portion, that extends along an intersection of the closure system 410 and an upper forward portion of the rapid-entry shoe or the shoe upper. An alignment line 407 extending through the pivot point 401 and the bend axis 406 may be farther above a footbed of the rapid-entry shoe than the coupling point 405 in both the collapsed and uncollapsed positions. However, in various embodiments, and with reference to FIGS. 5A and 5B, the alignment line 507 extending through the pivot point 501 and the bend axis 506 is closer to the footbed than the coupling point 505 in the collapsed position. That is, the alignment line 507 may be disposed between the footbed of the shoe and the coupling point 505, at least in the collapsed position. Such a configuration may enable bi-stability of the rapid-entry shoe. That is, the shoe in the uncollapsed position is not biased toward the collapsed position, and the shoe in the collapsed position is not biased toward the uncollapsed position. Additional details pertaining to biasing are included below.

Figure 3A:
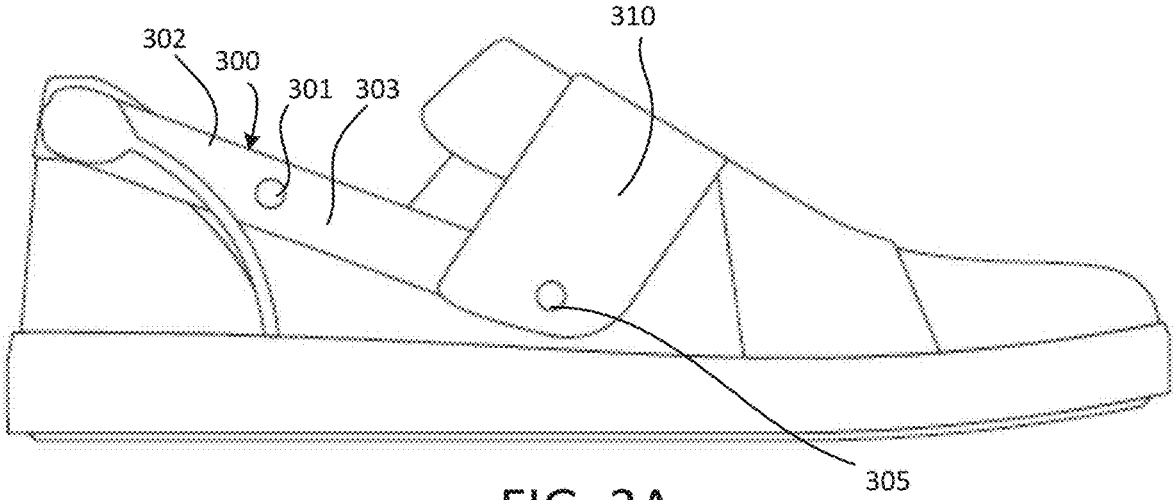
FIGS. 3A and 3B illustrate an example embodiment of a rapid-entry shoe having closure straps extending between actuator arms, in uncollapsed and collapsed positions, respectively.
Figure 3B:
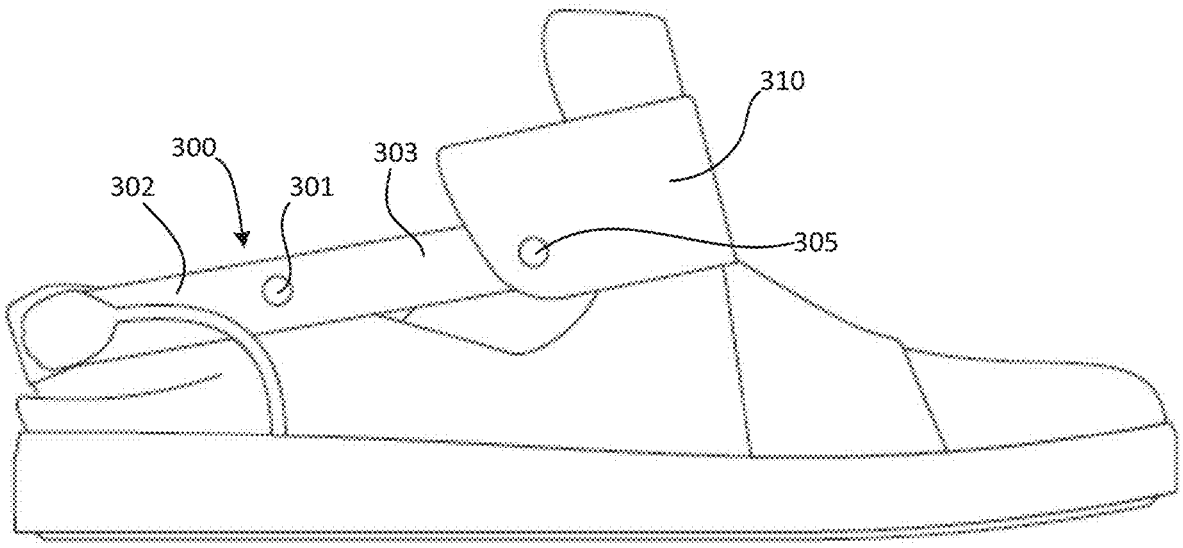

A closure system 110, as mentioned above, may include comprise a closure strap. In some embodiments, as illustrated in FIG. 1A, a first closure strap extends around the shoe upper between a first actuator arm on a medial side and the shoe upper or outsole on a lateral side, and a second closure strap extends around the shoe upper between a second actuator arm on a lateral side and the shoe upper or outsole on a medial side. In other embodiments, a closure strap extends around the shoe upper between a first actuator arm on a medial side and a second actuator arm on a lateral side as illustrated in FIGS. 3A and 3B. Persons skilled in the art will appreciate that the first and second actuator arms may be coupled to one another around the rear portion of the shoe, or the actuator arms may be independent of each other, or a single actuator arm may extend around the rear portion of the shoe and have respective pivot points on the medial and lateral side of the shoe.

In example embodiments, and returning to reference FIG. 1A, the closure system may be coupled to the tongue. In other example embodiments, the closure strap is coupled to the shoe upper at the vamp where it has a natural pivot point. In yet other example embodiments, the closure strap has multiple attachment points 111 to the actuator arm at the coupling point, e.g., to provide for adjustability.

In general, movement of the actuator arm from the uncollapsed position to the collapsed position can open the closure system (e.g., raise the tongue and/or closure strap away from the shoe upper), while movement of the actuator arm from the collapsed position to the uncollapsed position can close the closure system (e.g., lower the tongue and/or closure strap toward the shoe upper). As the actuator arm rotates it moves the closure system (and whatever it is coupled to) upward and away from the quarters and throat of the upper, making the opening wider.

In some embodiments, movement of the actuator arm from the collapsed position to the uncollapsed position can be facilitated by one or more resiliently deformable elements 115, e.g., extending from below the footbed of the shoe to the rear portion of the shoe, e.g., as described in U.S. Pat. No. 9,820,527, which is incorporated herein by reference for all purposes. The resiliently deformable element(s) 115 may provide a rebounding action to return the heal of the shoe to the closed position (uncollapsed position). The resiliently deformable element may be coupled to and may extend from below a footbed of the rapid-entry shoe.

In other example embodiments, and with momentary reference to FIGS. 7A, 7B, 7C and 7D, movement of actuator arm 700A, 700B, 700C, 700D from the collapsed position to the uncollapsed position can be facilitated by the inclusion of a biasing member 713A, 713B, 713C, 713D, such as an elastic gore or other material, located below the coupling point. The biasing member may exert a downward force to at least one of the forward segment 703A, 703B, 703C, 703D of the actuator arm 700A, 700B, 700C, 700D and the closure system 710A, 710B, 710C, 710D. Accordingly, because each of the embodiments depicted in FIGS. 7A,7B, 7C, and 7D is shown in the collapsed position, the biasing member 713A, 713B, 713C, 713D in each of these figures may be in an elongated state, thereby resulting in an increased bias to return to the shoe to the uncollapsed state.

Figure 8A:
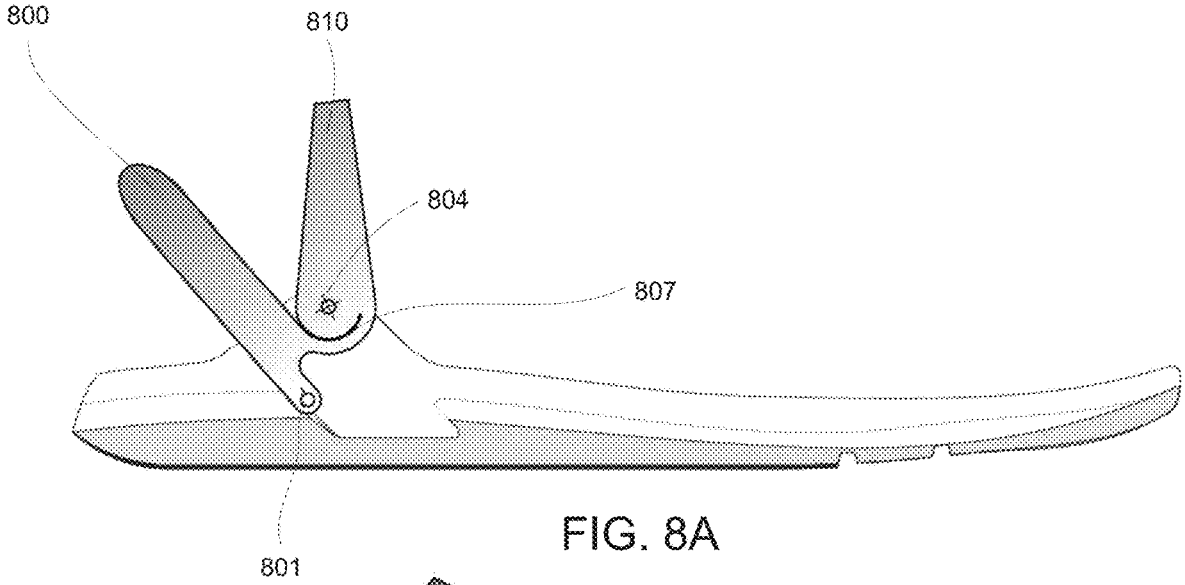
FIGS. 8A and 8B illustrate an example embodiment of a rapid-entry shoe having a living hinge, in uncollapsed and collapsed positions, respectively.
Figure 8B:
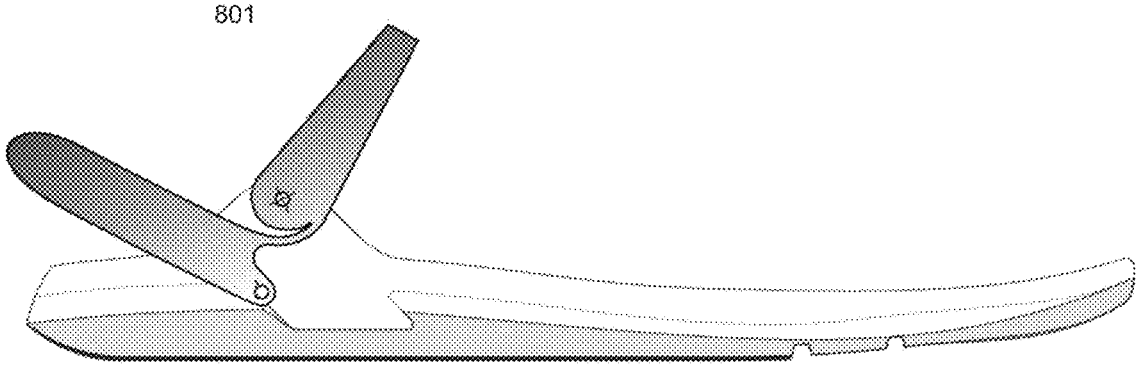

With reference now to FIGS. 8A and 8B, an additional embodiment is disclosed of a rapid-entry shoe, also having an uncollapsed configuration (FIG. 8A) and a collapsed configuration with a wider opening to receive the foot of an individual wearing the shoe (FIG. 8B). The shoe can comprise an actuator arm 800 and a closure system 810 (e.g., a closure trap or tongue). Actuator arm 800 and/or closure system 810 can extend between medial and lateral sides of the shoe, as previously mentioned. Both the actuator arm 800 and the closure system 810 may include respective pivot points 801, 804 (e.g., a first pivot point 801 and a second pivot point 804). In various embodiments, the actuator arm 800 and the closure system 810 are integrally formed of the same material (e.g., form a unitary, monolithic structure).

The shoe can comprise one or more pivot points 801 and 804, each on the medial and/or lateral side of the shoe, which in turn can comprise one or more of a rivet, pin, snap or other structure to provide for relative rotation. Pivot points 801 and 804 can be attached to a base, whether directly or indirectly. For example, pivot point 801 can provide for relative rotation between actuator arm 800 and a base. Similarly, pivot point 804 can provide for relative rotation between closure system 810 and a base. Optionally, one or more pivot points 801 and 804 can also anchor actuator arm

800 and/or closure system 810 relative to a base. As used herein, a "base" may refer to a stable base plate in the shoe, an outsole or portions thereof, a midsole or portions thereof, an insole or portions thereof, a wedge or portions thereof, the upper or portions thereof (e.g., a heel counter), or other suitable structure disposed between and/or adjacent to foregoing.

In various embodiments, a living hinge is formed between the actuator arm and the closure system. That is, the hinge may be made from the same material as and/or integral with the two pieces it connects. The living hinge may facilitate relative movement of the actuator arm and the closure system. That is, movement of the actuator arm from an uncollapsed position to a collapsed position opens the closure system, and wherein movement of the actuator arm from the collapsed position to the uncollapsed position closes the closure system. In various embodiments, the living hinge 807 is formed in part by a narrowed strip of the forward segment of the actuator arm 800 includes. The narrowed strip of material, which may be resiliently flexible, transitions from the actuator arm 800 to the closure system 810. An edge of the closure system may have a rounded edge, such that the narrowed strip of material extends adjacent to the rounded edge (e.g., extending forward and under the rounded edge of closure system 810). A slit may be defined between the rounded edge and the narrowed strip of material, wherein a dimension of the slit is greater in the collapsed position than in the uncollapsed position. In various embodiments, the narrowed strip of material extends from a forward edge of the closure system.

Actuator arm 800 and closure system 810 can be coupled to each other at a coupling point, as described supra, on the medial and/or lateral side of the shoe. In the illustrated embodiment, however, actuator arm 800 and closure system 810 are coupled to each other with a living hinge 807, on the medial and/or lateral side of the shoe.

As illustrated in the progression from an uncollapsed configuration (FIG. 8A) to a collapsed configuration (FIG. 8B), moving actuator arm 800 or closure system 810 in a first direction will move the other in a second direction, opposite the first, via hinge 807. Such movement of actuator arm 800 or closure system 810 in a first direction can be accomplished by a pushing or pulling motion exerted thereto, whether directly or indirectly, by an individual wearing the shoe. This embodiment may be particularly advantageous in connection with a high top style boot. The actuator arms can be returned to their original positions by lestic or deformable elements positioned to pull or push the arms back into place.

Figure 9A:
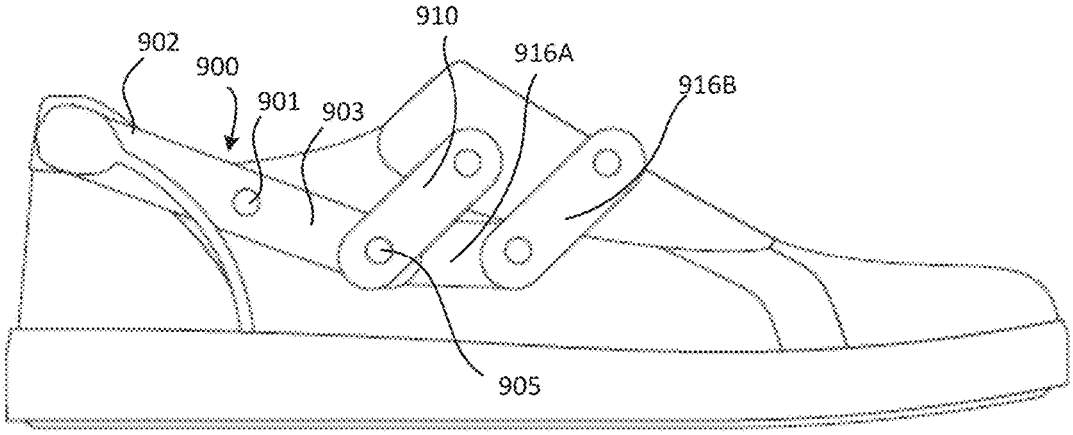
FIGS. 9A and 9B illustrate an example embodiment of a rapid-entry shoe having multiple links extending from an actuator arm, in uncollapsed and collapsed positions, respectively.
Figure 9B:
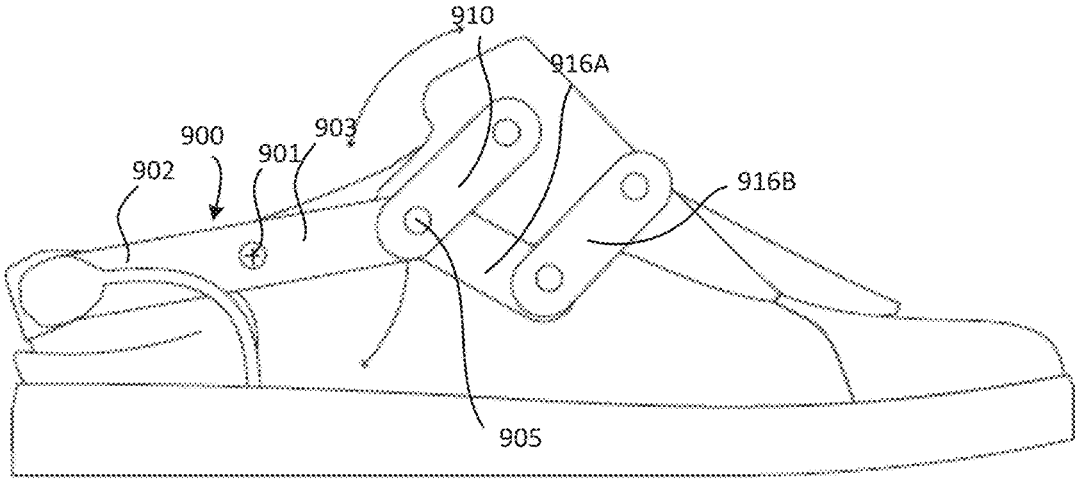
Figure 10A:
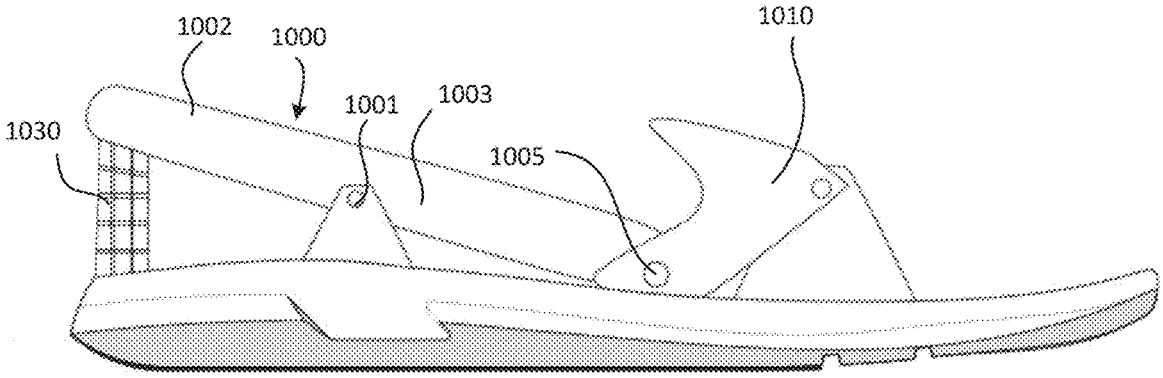
FIGS. 10A, 10B, 10C, 10D, and 10E illustrate example embodiments of a rapid-entry shoe having a collapsible rear support.
Figure 10B:
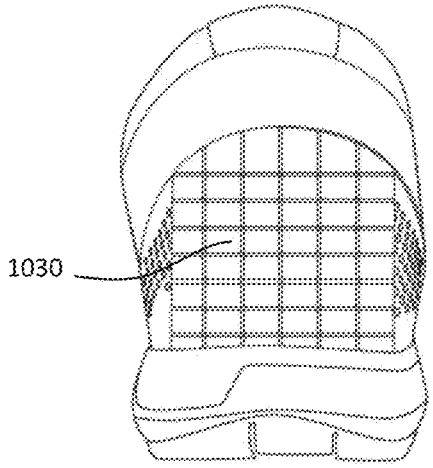
Figure 10C:
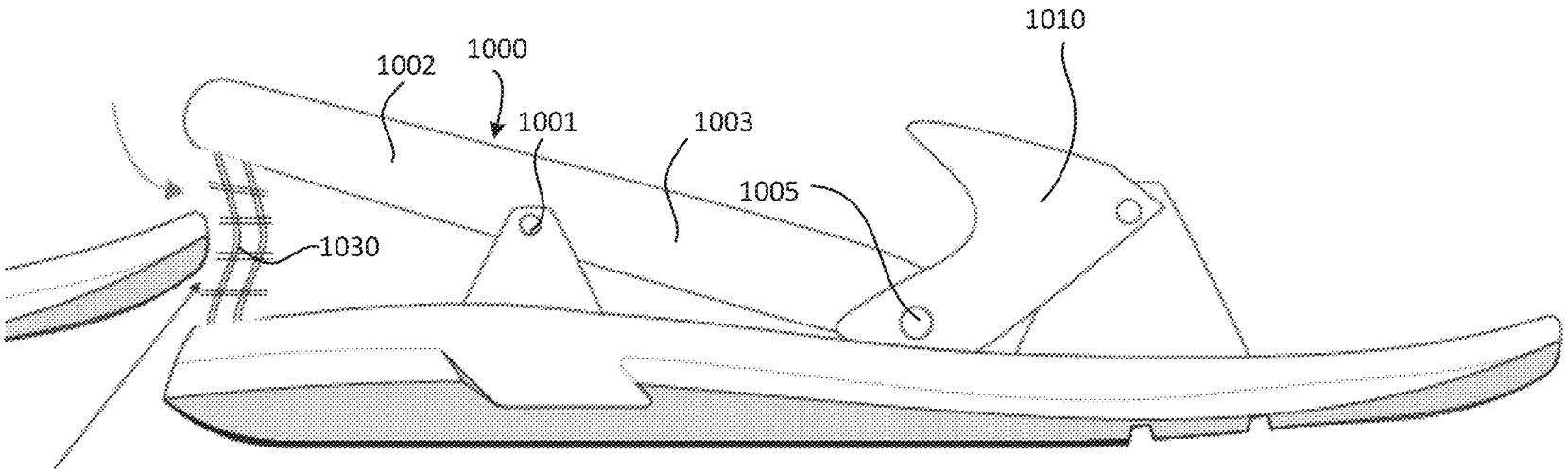
Figure 10D:
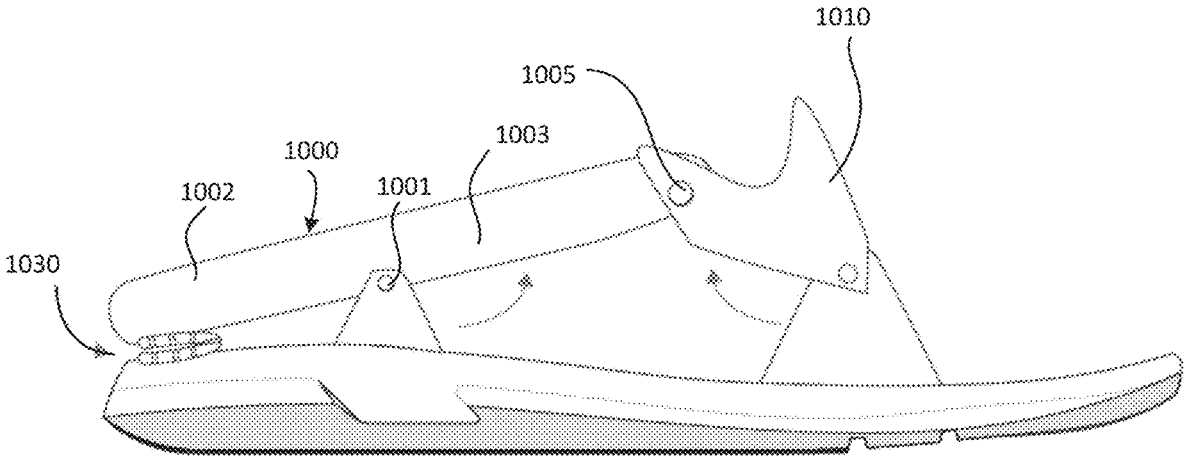
Figure 10E:
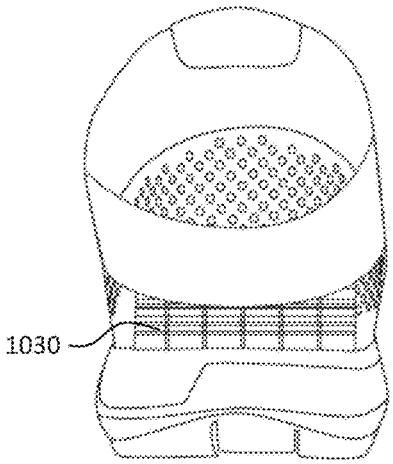

In various embodiments, and with reference to FIGS. 9A and 9B, the closure system may include a link 910 coupled to the forward segment 903 of the actuator arm 900 at the coupling point 905. The link 910 may extend from the coupling point 905 and may be coupled to or form a first part of a forward upper portion of the rapid-entry shoe. The link 910 may be a first link, and the closure system may further include a second link also coupled to the forward segment 903 of the actuator arm 900 at the coupling point 905. The second link may extend from the coupling point and may be coupled to or form a second part of the forward upper portion of the rapid-entry shoe. The second link may include a first section 916A and a second section 916B.

In various embodiments, and with reference to FIGS. 10A, 10B, 10C, 10D, and 10E, the rapid entry shoe includes a rear support portion 1030 extending between the rear segment 1002 and a base of the rapid-entry shoe. The rear support portion 1030 may be configured to bias the rapid-entry shoe toward the uncollapsed position, but can be momentarily deflected to allow the rear support portion 1030 to collapse to transition from the uncollapsed position to the collapsed position. The rear support portion 1030 may include horizontal and vertical grooves, thereby allowing bending in two directions, but only a single direction at a time.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

We claim:

1. A rapid-entry shoe comprising:

an upper;

an actuator arm comprising a pivot point, the actuator arm extending continuously around an upper rearward portion of the rapid-entry shoe from a medial side of the rapid entry shoe to a lateral side of the rapid entry shoe; and a closure system extending continuously around an upper forward portion of the rapid-entry shoe from the medial side to the lateral side, the closure system coupled to the actuator arm at a coupling point on each of the medial side and the lateral side;

wherein the actuator arm pivots or rotates relative to the upper about the pivot point;

wherein the actuator arm and the closure system are rotatable relative to each other at the coupling point;

wherein movement of the actuator arm from an uncollapsed position to a collapsed position correlates simultaneously with opening of the closure system, and wherein movement of the actuator arm from the collapsed position to the uncollapsed position correlates simultaneously with closing of the closure system.

2. The rapid-entry shoe of claim 1, wherein the actuator arm comprises a rear segment and a forward segment, wherein the pivot point is disposed between the rear segment and the forward segment and the closure system is coupled to the forward segment of the actuator arm.

3. The rapid-entry shoe of claim 2, wherein movement of the actuator arm from the uncollapsed position to the collapsed position comprises downward rotational movement of the rear segment and upward rotational movement of the forward segment, and wherein movement of the actuator arm from the collapsed position to the uncollapsed position comprises upward rotational movement of the rear segment and downward rotational movement of the forward segment.

4. The rapid-entry shoe of claim 1, wherein in the uncollapsed position the coupling point is closer to a footbed of the rapid-entry shoe than the pivot point, and wherein in the collapsed position the coupling point is farther above the footbed than the pivot point.

5. The rapid-entry shoe of claim 1, further comprising a bend axis between a forward end of the closure system and the upper forward portion of the rapid-entry shoe, wherein an alignment line extending through the pivot point and the bend axis is closer to a footbed of the rapid-entry shoe when the actuator arm is in the collapsed position than the coupling point such that the alignment line is disposed between the coupling point and the footbed.

6. The rapid-entry shoe of claim 1, wherein the pivot point is disposed above a footbed of the rapid-entry shoe.

7. The rapid-entry shoe of claim 1, wherein the actuator arm is bi-stable in that it is stable in both the uncollapsed position and the collapsed position.

8. A rapid-entry shoe comprising:

an actuator arm comprising a rear segment, a pivot point, and a forward segment, wherein the pivot point is disposed between the rear segment and the forward segment, the actuator arm extending completely around an upper rearward portion of the rapid-entry shoe from a first side of the rapid entry shoe to a second side of the rapid entry shoe opposite the first side; and a closure system extending completely around an upper forward portion of the rapid-entry shoe from the first side to the second side, the closure system coupled to the forward segment of the actuator arm at a coupling point on each of the first side and the second side;

wherein the coupling point enables movement of the actuator arm relative to the closure system;

wherein movement of the actuator arm from an uncollapsed position to a collapsed position comprises downward rotational movement of the rear segment and upward rotational movement of the forward segment and structurally correlates with opening of the closure system;

wherein closing of the closure system structurally correlates with movement of the actuator arm from the collapsed position to the uncollapsed position comprising upward rotational movement of the rear segment and downward rotational movement of the forward segment.

9. The rapid-entry shoe of claim 8, wherein in the uncollapsed position the coupling point is closer to a footbed of the rapid-entry shoe than the pivot point, and wherein in the collapsed position the coupling point is farther above the footbed than the pivot point.

10. The rapid-entry shoe of claim 8, further comprising a bend axis between a forward end of the closure system and the upper forward portion of the rapid-entry shoe, wherein an alignment line extending through the pivot point and the bend axis is closer to a footbed of the rapid-entry shoe when the actuator arm is in the collapsed position than the coupling point such that the alignment line is disposed between the coupling point and the footbed.

11. The rapid-entry shoe of claim 8, wherein the pivot point is disposed above a footbed of the rapid-entry shoe.

12. The rapid-entry shoe of claim 8, wherein the actuator arm is bi-stable in that it is stable in both the uncollapsed position and the collapsed position.

* * * * *